US012774812B1

(12) United States Patent
Crawley et al.

(10) Patent No.: US 12,774,812 B1
(45) Date of Patent: Oct. 27, 2026

(54) FUEL INJECTOR HAVING AN IMMERSED PORTION WITH A PROTRUDING WING

(71) Applicant: GE Vernova Infrastructure Technology LLC, Greenville, SC (US)

(72) Inventors: Bradley D. Crawley, Greenville, SC (US); Michael John Hughes, State College, PA (US); Homayoon Feiz, Greenville, SC (US); Frank A. Mignano, Surprise, AZ (US)

(73) Assignee: GE Vernova Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 19/280,626

(22) Filed: Jul. 25, 2025

(51) Int. Cl.
*F23R 3/28* (2006.01)
*F23R 3/16* (2006.01)
*F23R 3/34* (2006.01)

(52) U.S. Cl.
CPC ..... *F23R 3/286* (2013.01); *F23R 3/16* (2013.01); *F23R 3/34* (2013.01); *F23D 2900/14004* (2013.01); *F23R 2900/03341* (2013.01)

(58) Field of Classification Search
CPC .... F23R 3/16; F23R 3/286; F23R 3/34; F23R 3/346; F23R 2900/03341; F23D 2900/14004
See application file for complete search history.

(56) References Cited

U.S. PATENT DOCUMENTS 2,930,192 A 3/1960 Johnson
3,374,624 A * 3/1968 Coplin ..... F23R 3/16 416/97 R
3,872,664 A 3/1975 Lohmann et al.
4,062,182 A 12/1977 Fehler et al.
4,910,957 A 3/1990 Moreno et al.
4,928,481 A 5/1990 Joshi et al.
5,193,346 A 3/1993 Kuwata et al.
5,647,215 A * 7/1997 Sharifi ..... F23D 17/002 239/431
5,749,219 A 5/1998 DuBell
6,047,550 A 4/2000 Beebe
6,192,688 B1 2/2001 Beebe
6,311,471 B1 * 11/2001 Waldherr ..... F23R 3/283 60/39.55
6,868,676 B1 3/2005 Haynes
6,868,678 B2 3/2005 Mei et al.
7,886,539 B2 2/2011 Cai
8,490,398 B2 * 7/2013 Poyyapakkam ..... F23R 3/14 60/737

(Continued)

OTHER PUBLICATIONS

Co-Pending U.S. Appl. No. 17/975,113 filed Oct. 27, 2022.

*Primary Examiner* — Alain Chau
(74) *Attorney, Agent, or Firm* — Dority & Manning, P.A.

(57) ABSTRACT

A fuel injector includes a premix portion that defines a premix passage. The fuel injector further includes an immersed portion extending vertically from a base at the premix portion to a terminal edge. The immersed portion extends longitudinally between a leading edge and a trailing edge. The immersed portion includes a leading portion and a body portion. The leading portion extends from the leading edge to the body portion. The body portion extends from the leading portion to the trailing edge. The leading portion includes at least one wing that protrudes transversely from the body portion. The at least one wing is aligned with the premix passage.

20 Claims, 12 Drawing Sheets

(56) References Cited

U.S. PATENT DOCUMENTS

| | | | | |
|---|---|---|---|---|
| 9,228,499 | B2 | 1/2016 | Stryapunin | |
| 9,291,098 | B2 | 3/2016 | Chen et al. | |
| 10,816,203 | B2 * | 10/2020 | Jones | F23R 3/06 |
| 10,865,992 | B2 * | 12/2020 | DiCintio | F23R 3/002 |
| 11,067,281 | B1 | 7/2021 | Garcia et al. | |
| 11,371,710 | B2 | 6/2022 | Bulat | |
| 11,566,790 | B1 | 1/2023 | Hughes et al. | |
| 12,025,314 | B2 | 7/2024 | Hughes et al. | |
| 12,228,285 | B2 * | 2/2025 | Jeong | F02C 7/222 |
| 12,429,223 | B2 * | 9/2025 | Miranda | F02C 7/228 |
| 2007/0271927 | A1 | 11/2007 | Myers et al. | |
| 2007/0277528 | A1 | 12/2007 | Homitz et al. | |
| 2008/0078182 | A1 * | 4/2008 | Evulet | F02C 3/14 60/737 |
| 2008/0264033 | A1 | 10/2008 | Lacy et al. | |
| 2009/0084082 | A1 | 4/2009 | Martin et al. | |
| 2010/0034643 | A1 | 2/2010 | Davis, Jr. et al. | |
| 2010/0071376 | A1 | 3/2010 | Wiebe et al. | |
| 2010/0170219 | A1 | 7/2010 | Venkataraman et al. | |
| 2010/0170252 | A1 | 7/2010 | Venkataraman et al. | |
| 2010/0174466 | A1 | 7/2010 | Davis, Jr. et al. | |
| 2010/0229557 | A1 | 9/2010 | Matsumoto et al. | |
| 2010/0242482 | A1 | 9/2010 | Kraemer et al. | |
| 2011/0067402 | A1 | 3/2011 | Wiebe et al. | |
| 2011/0179803 | A1 | 7/2011 | Berry et al. | |
| 2011/0185735 | A1 | 8/2011 | Snyder | |
| 2011/0296839 | A1 | 12/2011 | Van Nieuwenhuizen et al. | |
| 2012/0285172 | A1 * | 11/2012 | Poyyapakkam | F23R 3/14 60/737 |
| 2013/0067921 | A1 | 3/2013 | Hadley et al. | |
| 2013/0174558 | A1 | 7/2013 | Stryapunin | |
| 2013/0234396 | A1 | 9/2013 | Willis et al. | |
| 2014/0260269 | A1 | 9/2014 | Davis, Jr. et al. | |
| 2015/0275755 | A1 | 10/2015 | Ogata et al. | |
| 2015/0276226 | A1 | 10/2015 | Laster et al. | |
| 2015/0285501 | A1 | 10/2015 | DiCintio et al. | |
| 2015/0285504 | A1 | 10/2015 | Melton | |
| 2016/0258629 | A1 | 9/2016 | Slobodyanskiy et al. | |
| 2017/0176014 | A1 | 6/2017 | Hughes et al. | |
| 2017/0307210 | A1 | 10/2017 | Hirano et al. | |
| 2018/0087390 | A1 | 3/2018 | Morgan et al. | |
| 2018/0187893 | A1 | 7/2018 | DiCintio et al. | |
| 2018/0328588 | A1 | 11/2018 | Lemon et al. | |
| 2022/0026069 | A1 | 1/2022 | Paniharam et al. | |
| 2022/0412563 | A1 | 12/2022 | Giridharan et al. | |
| 2023/0136865 | A1 * | 5/2023 | Hughes | F23R 3/20 60/776 |
| 2023/0296253 | A1 * | 9/2023 | Miranda | F02C 7/228 60/773 |

* cited by examiner

FUEL INJECTOR HAVING AN IMMERSED PORTION WITH A PROTRUDING WING

FEDERALLY SPONSORED RESEARCH

This invention was made with government support under contract number DE-FE0032173 awarded by the Department of Energy. The U.S. government may have certain rights in the invention.

FIELD

The present disclosure relates generally to fuel injector assemblies for gas turbine combustors and, more particularly, to fuel injector assemblies for use with an axial fuel staging (AFS) system associated with such combustors.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine engine via the exhaust section.

In some combustors, the generation of combustion gases occurs at two or more axially spaced stages. Such combustors are referred to herein as including an "axial fuel staging" (AFS) system, which delivers fuel and an oxidant to one or more fuel injectors downstream of the head end of the combustor. In a combustor with an AFS system, a primary fuel nozzle at an upstream end of the combustor injects fuel and air (or a fuel/air mixture) in an axial direction into a primary combustion zone, and an AFS fuel injector located at a position downstream of the primary fuel nozzle injects fuel and air (or a second fuel/air mixture) as a cross-flow into a secondary combustion zone downstream of the primary combustion zone. The cross-flow is generally transverse to the flow of combustion products from the primary combustion zone.

Traditional gas turbine engines include one or more combustors that burn a mixture of natural gas and air within the combustion chamber to generate the high pressure and temperature combustion gases. As a byproduct, oxides of nitrogen (NOx), carbon dioxide ($CO_2$), and other pollutants are created and expelled by the exhaust section. Regulatory requirements for low emissions from gas turbines are continually growing more stringent, and environmental agencies throughout the world are now requiring even lower rates of emissions of NOx and other pollutants from both new and existing gas turbines.

Burning a blend of natural gas and high amounts of hydrogen and/or burning pure hydrogen instead of natural gas within the combustor would significantly reduce or eliminate the emission of $CO_2$. However, because hydrogen burning characteristics are different than those of natural gas, traditional combustion systems, including traditional AFS fuel injectors, are not capable of burning high levels of hydrogen and/or pure hydrogen without issue. For example, burning high levels of hydrogen and/or pure hydrogen within a traditional combustion system could promote flashback or flame holding conditions in which the combustion flame migrates towards the fuel being supplied by the injector, possibly causing severe damage to the injector in a relatively short amount of time.

As such, a fuel injector capable of delivering alternative fuels (such as hydrogen) and air to a secondary combustion zone, without causing flame holding or flashback issues, is desired in the art.

BRIEF DESCRIPTION

Aspects and advantages of the fuel injectors and combustors in accordance with the present disclosure will be set forth in part in the following description, or may be obvious from the description, or may be learned through practice of the technology.

In accordance with one embodiment, a fuel injector is provided. The fuel injector includes a mutually orthogonal coordinate system having a longitudinal direction, a transverse direction, and a vertical direction. The fuel injector includes a premix portion that defines a premix passage. The fuel injector further includes an immersed portion extending vertically from a base at the premix portion to a terminal edge. The immersed portion extends longitudinally between a leading edge and a trailing edge. The immersed portion includes a leading portion and a body portion. The leading portion extends from the leading edge to the body portion. The body portion extends from the leading portion to the trailing edge. The leading portion includes at least one wing that protrudes transversely from the body portion. The at least one wing is aligned with the premix passage.

In accordance with another embodiment, a combustor is provided. The combustor includes a combustion liner that defines a combustion chamber. The combustor further includes a fuel injector extending at least partially through the combustion liner. The fuel injector defines a mutually orthogonal coordinate system having a longitudinal direction, a transverse direction, and a vertical direction. The fuel injector includes a premix portion that defines a premix passage. The fuel injector further includes an immersed portion extending vertically from a base at the premix portion to a terminal edge. The immersed portion extends longitudinally between a leading edge and a trailing edge. The immersed portion includes a leading portion and a body portion. The leading portion extends from the leading edge to the body portion. The body portion extends from the leading portion to the trailing edge. The leading portion includes at least one wing that protrudes transversely from the body portion. The at least one wing is aligned with the premix passage.

These and other features, aspects and advantages of the present fuel injectors and combustors will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present fuel injectors and combustors including the best mode of making and using the present systems and methods, directed to one of ordinary skill in the art, is set forth in the specification, which makes reference to the appended figures, in which.

DETAILED DESCRIPTION

Figure 1:
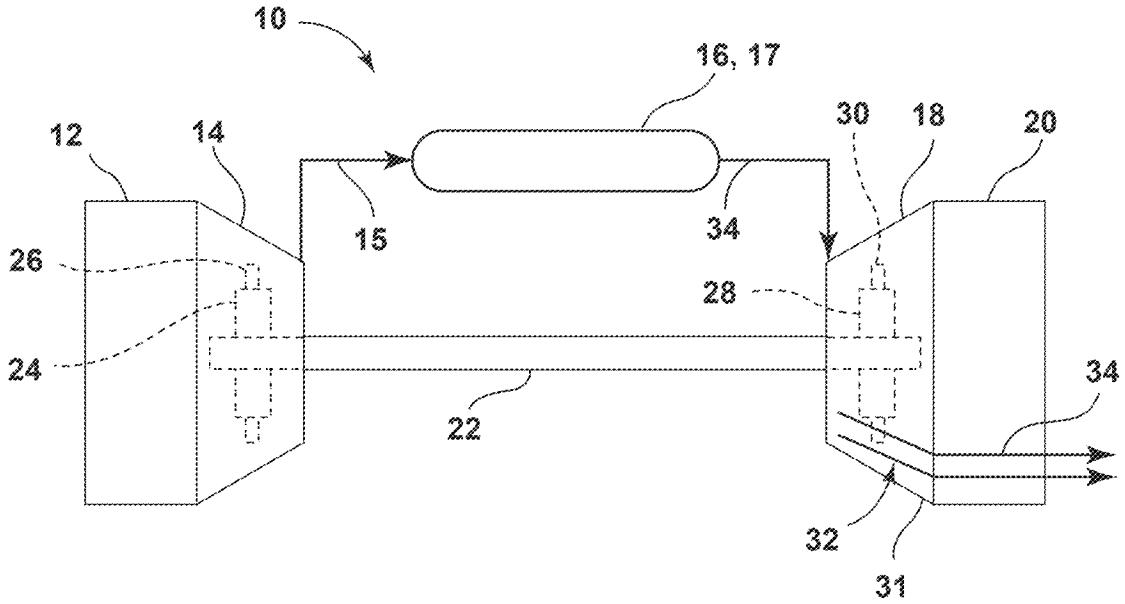
FIG. 1 is a schematic illustration of a turbomachine, in accordance with embodiments of the present disclosure.

Reference now will be made in detail to embodiments of the present fuel injectors and combustors, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the subject technology. As used herein, the terms "first", "second", and "third" may be used interchangeably to distinguish one component from another and are not intended to signify location or importance of the individual components.

The term "fluid" may refer to a gas or a liquid. The term "fluid communication" means that a fluid is capable of flowing or being conveyed between the areas specified.

As used herein, the terms "upstream" (or "forward") and "downstream" (or "aft") refer to the relative direction with respect to fluid flow in a fluid pathway.

For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

Terms of approximation, such as "about," "approximately," "generally," and "substantially," are not to be limited to the precise value specified. In at least some instances, the approximating language may correspond to the precision of an instrument for measuring the value or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. The terms "directly coupled," "directly fixed," "directly attached to," and the like indicate that a first component is joined to a second component with no intervening structures. As used herein, the terms "comprises," "comprising," "includes," "including," "has," "having" or any other variations thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "and/or" refers to a condition satisfied by any one of the following: A is true (or present) and B is false (or not present); A is false (or not present) and B is true (or present); and both A and B are true (or present).

Here and throughout the specification and claims, range limitations are identified and include all the sub-ranges contained therein unless context or language indicates otherwise. For example, all ranges disclosed herein are inclusive of the endpoints, and the endpoints are independently combinable with each other.

Referring now to the drawings, FIG. 1 illustrates a schematic diagram of one embodiment of a turbomachine, which in the illustrated embodiment is a gas turbine 10. Although an industrial or land-based gas turbine is shown and described herein, the present disclosure is not limited to an industrial and/or land-based gas turbine unless otherwise specified in the claims. For example, the technology as described herein may be used in any type of turbomachine including but not limited to a steam turbine, an aircraft gas turbine, or a marine gas turbine.

As shown, gas turbine 10 generally includes an inlet section 12, a compressor section 14 disposed downstream of the inlet section 12, a plurality of combustors 17 (FIG. 2) within a combustion section 16 disposed downstream of the compressor section 14, a turbine section 18 disposed downstream of the combustion section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14. The compressor section 14 further includes a plurality of stationary vanes (not shown), which are arranged in stages with the rotor blades 26 and which direct the flow against the rotor blades 26.

The turbine section 18 may generally include a plurality of rotor disks 28 (one of which is shown) and a plurality of rotor blades 30 extending radially outwardly from and connected to each rotor disk 28. Each rotor disk 28 in turn may be coupled to or form a portion of the shaft 22 that extends through the turbine section 18. The turbine section 18 further includes an outer casing 31 that circumferentially surrounds the turbine portion of the shaft 22 and the rotor blades 30, thereby at least partially defining a hot gas path 32 through the turbine section 18. The turbine section 18 further includes a plurality of stationary vanes (not shown), which are arranged in stages with the rotor blades 30 and which direct the flow against the rotor blades 30.

During operation, a working fluid such as air flows through the inlet section 12 and into the compressor section 14 where the air is progressively compressed by multiple compressor stages of rotating blades and stationary vanes, thus providing pressurized air 15 to the combustors 17 of the combustion section 16. The pressurized air is mixed with fuel and burned within each combustor 17 to produce combustion gases 34. The combustion gases 34 flow through the hot gas path 32 from the combustion section 16 into the turbine section 18, in which energy (kinetic and/or thermal) is transferred from the combustion gases 34 to the rotor blades 30, causing the shaft 22 to rotate. The mechanical rotational energy may then be used to power the compressor section 14 and/or to generate electricity (e.g., when the shaft 22 is coupled to a generator, not shown). The combustion gases 34 exiting the turbine section 18 may then be exhausted from the gas turbine 10 via the exhaust section 20.

Figure 2:
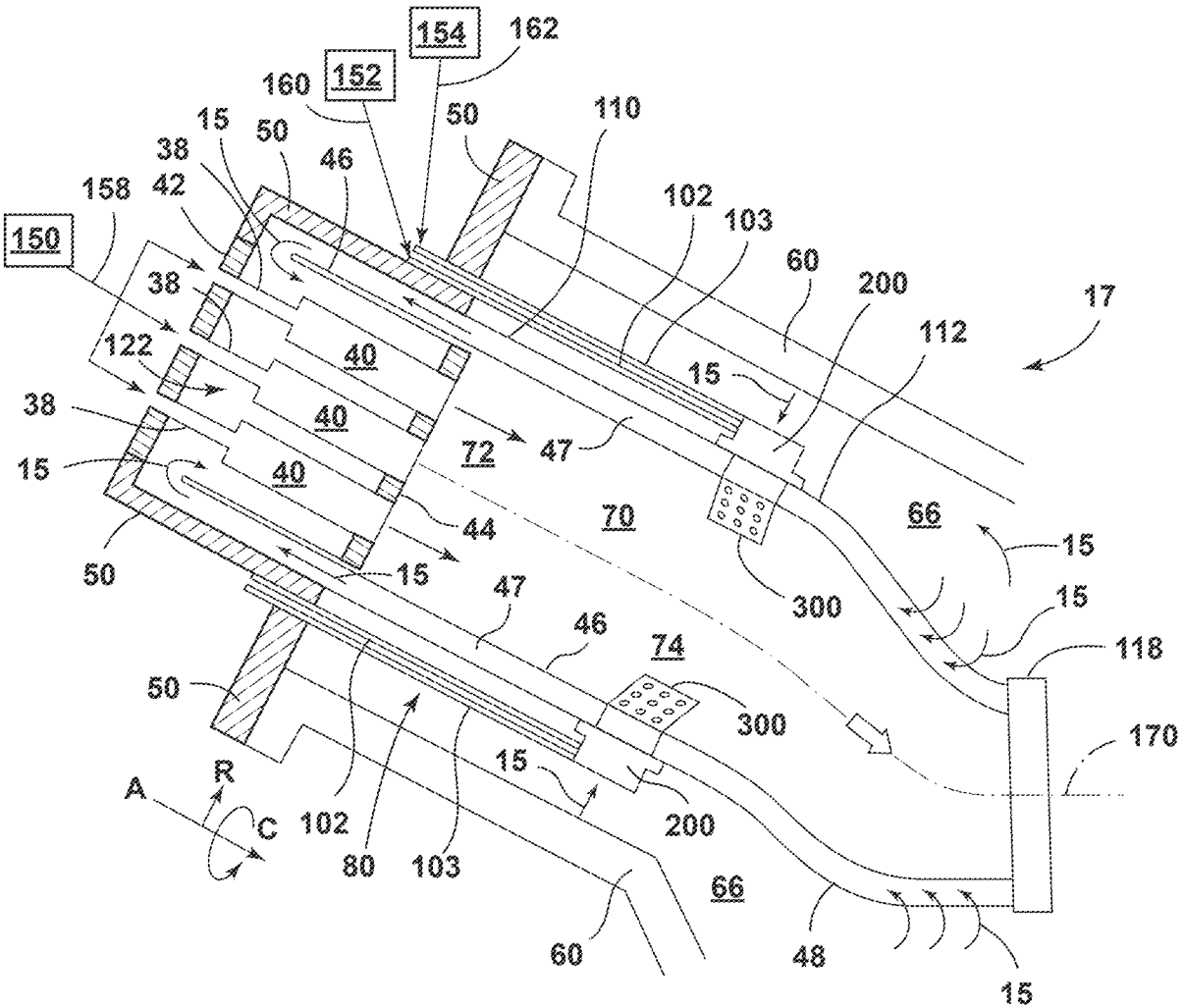
FIG. 2 illustrates a cross-sectional view of a combustor suitable for use in the turbomachine of FIG. 1, in accordance with embodiments of the present disclosure.

FIG. 2 is a schematic representation of a combustor 17, as may be included in a can annular combustion system for the gas turbine 10. In a can annular combustion system, a plurality of combustors 17 (e.g., 8, 10, 12, 14, 16, or more) are positioned in an annular array about the shaft 22 that connects the compressor section 14 to the turbine section 18.

As shown in FIG. 2, the combustor 17 may define a cylindrical coordinate system having an axial direction A that extends along an axial centerline 170. The combustor may also define a circumferential direction C which extends around the axial direction A and the axial centerline 170. The combustor 17 may further define a radial direction R perpendicular to the axial direction A and the axial centerline 170. While FIGS. 3 through 6B illustrate various views of a fuel injector 80 with reference to the cylindrical coordinate system of the combustor 17, the fuel injector 80 is not necessarily limited to use in the combustor 17 illustrated in FIG. 2, and the fuel injector 80 may be utilized in any type of combustion system having any suitable coordinate system or arrangement (e.g., an annular combustion system).

FIG. 2 illustrates a combustor 17 having one or more exemplary fuel injectors 80 (also referred to as an axial fuel staging (AFS) system), as discussed further herein. The combustor 17 includes a combustion liner 46 that defines a combustion chamber 70. The combustion liner 46 may be positioned within (i.e., circumferentially surrounded by) an outer sleeve 48, such that an annulus 47 is formed therebetween. At least one fuel nozzle 40 may be positioned at the forward end of the combustor 17. Fuel may be directed through first fuel supply conduits 38, which extend through an end cover 42, and into the fuel nozzles 40. The fuel nozzles 40 convey the fuel and compressed air 15 into a primary combustion zone 72, where combustion occurs. In some embodiments, the fuel and compressed air 15 are combined as a mixture prior to reaching the primary combustion zone 72.

The combustion liner 46 may contain and convey combustion gases to the turbine section 18. The combustion liner 46 defines the combustion chamber 70 within which combustion occurs. As shown in FIG. 2, the combustion liner 46 may extend between the fuel nozzles 40 and an aft frame 118. The combustion liner 46 may have a cylindrical liner portion and a tapered transition portion that is separate from the cylindrical liner portion, as in many conventional combustion systems. Alternately, the combustion liner 46 may have a unified body (or "unibody") construction, in which the cylindrical portion and the tapered portion are integrated with one another. Thus, any discussion of the combustion liner 46 herein is intended to encompass both conventional combustion systems having a separate liner and transition piece and those combustion systems having a unibody liner. Moreover, the present disclosure is equally applicable to those combustion systems in which the transition piece and the stage one nozzle of the turbine section 18 are integrated into a single unit, sometimes referred to as a "transition nozzle" or an "integrated exit piece."

The combustion liner 46 may be surrounded by an outer sleeve 48, which is spaced radially outward of the combustion liner 46 to define an annulus 47 through which compressed air 15 flows to a head end of the combustor 17. Heat is transferred convectively from the combustion liner 46 to the compressed air 15, thus cooling the combustion liner 46 and warming the compressed air 15.

In exemplary embodiments, the outer sleeve 48 may include a flow sleeve 110 at the forward end and an impingement sleeve 112 at the aft end. The flow sleeve 110 and the impingement sleeve 112 may be coupled to one another. Alternately, the outer sleeve 48 may have a unified body (or "unisleeve") construction, in which the flow sleeve 110 and the impingement sleeve 112 are integrated with one another in the axial direction. As before, any discussion of the outer sleeve 48 herein is intended to encompass both conventional combustion systems having a separate flow sleeve 110 and impingement sleeve 112 and combustion systems having a unisleeve outer sleeve.

The forward casing 50 and the end cover 42 of the combustor 17 define the head end air plenum 122, which includes one or more fuel nozzles 40. The fuel nozzles 40 may be any type of fuel nozzle, such as bundled tube fuel nozzles (often referred to as "micromixers") or swirler nozzles (often referred to as "swozzles"). For example, the fuel nozzles 40 are positioned within the head end air plenum 122 defined at least partially by the forward casing 50. In many embodiments, the fuel nozzles 40 may extend from the end cover 42. For example, each fuel nozzle 40 may be coupled to an aft surface of the end cover 42 via a flange (not shown). As shown in FIG. 2, the at least one fuel nozzle 40 may be partially surrounded by the combustion liner 46. The aft, or downstream ends, of the fuel nozzles 40 extend through a cap plate 44 that defines the upstream end of the combustion chamber 70.

The fuel nozzles 40 may be in fluid communication with a first fuel supply 150 configured to supply a first fuel 158 to the fuel nozzles 40. In many embodiments, the first fuel 158 may be a fuel mixture containing natural gas (such as methane, ethane, propane, or other suitable natural gas) and hydrogen. In other embodiments, the first fuel 158 may be pure natural gas or pure hydrogen (e.g., 200% hydrogen), such that the first fuel is not a mixture of multiple fuels.

In exemplary embodiments, the first fuel 158 and compressed air 15 may mix together within the fuel nozzles 40 to form a first mixture of compressed air 15 and the first fuel 158 before being ejected (or injected) by the fuel nozzles 40 into the primary combustion zone 72. The first mixture of the first fuel 158 and compressed air 15 may be injected into the primary combustion zone 72 and ignited to generate a first flow of combustion gases 164 having a first temperature.

The forward casing 50 may be connected fluidly and mechanically to a compressor discharge casing 60, which defines a high pressure plenum 66 around the combustion liner 46 and the outer sleeve 48. Compressed air 15 from the compressor section 14 travels through the high pressure plenum 66 and enters the combustor 17 via apertures (not shown) in the downstream end of the outer sleeve 48 (as indicated by arrows near the aft frame 118). Compressed air travels upstream through the annulus 47 and is turned by the end cover 42 to enter the fuel nozzles 40 and to cool the head end. In particular, compressed air 15 flows from high pressure plenum 66 into the annulus 47 at an aft end of the combustor 17, via openings defined in the outer sleeve 48. The compressed air 15 travels upstream from the aft end of the combustor 17 to the head end air plenum 122, where the compressed air 15 reverses direction and enters the fuel nozzles 40.

In the exemplary embodiment, a fuel injector 80 is provided to deliver a second fuel/air mixture and/or a third fuel to the secondary combustion zone 74. For example, the fuel injector 80 may include a premix portion 200 and an immersed portion 300. The premix portion 200 may introduce a second flow of fuel and air to the secondary combustion zone 74, and the immersed portion 300 may separately introduce a pure fuel (e.g., not mixed with air) into the secondary combustion zone 74.

The primary combustion zone 72 and the secondary combustion zone 74 may each be portions of the combustion chamber 70 and therefore may be defined by the combustion liner 46. For example, the primary combustion zone 72 may be defined from an outlet of the fuel nozzles 40 to the fuel injector 80, and the secondary combustion zone may be defined from the fuel injector 80 to the aft frame 118. In this arrangement, the forwardmost boundary of the fuel injector 80 may define the end of the primary combustion zone 72 and the beginning of the secondary combustion zone 74 (e.g., at an axial location where a second flow of fuel and air are introduced).

Such a combustion system having axially separated combustion zones is described as an "axial fuel staging" (AFS) system. The fuel injectors 80 may be circumferentially spaced apart from one another on the outer sleeve 48 (e.g., equally spaced apart in some embodiments). In many embodiments, the combustor 17 may include four fuel injectors 80 spaced apart from one another and configured to inject a second mixture of fuel and air into a secondary combustion zone 74 via the premix portion 200 and configured to inject a flow of pure fuel (e.g., hydrogen) via the immersed portion 300, in order to increase the combustion gases 34 and temperature thereof. In other embodiments, the combustor 17 may include any number of fuel injectors 80 (e.g., 1, 2, 3, or up to 10 or more).

As shown in FIG. 2, each fuel injector 80 may include the premix portion 200, the immersed portion 300, a second fuel supply conduit 102 that supplies a second fuel (such as pure hydrogen or a natural gas and hydrogen mixture comprising greater than 80% hydrogen) to the premix portion 200, and a third fuel supply conduit 103 that supplies a third fuel (such as pure hydrogen or a natural gas and hydrogen mixture comprising greater than 80% hydrogen) to the immersed portion 300. For example, each premix portion 200 may be in fluid communication, at least partially via the second fuel supply conduit 102, with a second fuel supply 152 configured to supply a second fuel 160 to each premix portion 200. In many embodiments, the second fuel 160 may be a fuel mixture containing natural gas (such as methane, ethane, propane, or other suitable natural gas) and hydrogen. In other embodiments, the second fuel 160 may be pure natural gas or pure hydrogen (e.g., 200% hydrogen), such that the second fuel includes no other fuels mixed therein. Similarly, each immersed portion 300 may be in fluid communication, at least partially via the third fuel supply conduit 103, with a third fuel supply 154 configured to supply a third fuel 162 to each immersed portion 300. In many embodiments, the third fuel 162 may be a fuel mixture containing natural gas (such as methane, ethane, propane, or other suitable natural gas) and hydrogen. In other embodiments, the third fuel 162 may be pure natural gas or pure hydrogen (e.g., 200% hydrogen), such that the third fuel includes no other fuels mixed therein.

Because the fuel nozzles 40, the premix portions 200, and the immersed portions 300 are separately fueled (e.g., via the fuel supplies 150, 152, and 154), they may allow the combustor a wide range of operational flexibility. For example, each of the fuel nozzles 40, the premix portions 200, and the immersed portions 300 may be supplied with a different fuel or fuel mixture. Particularly, in exemplary embodiments, each of the fuel nozzles 40, the premix portions 200, and the immersed portions 300 may be supplied pure hydrogen or a fuel mixture that contains mostly hydrogen (e.g., greater than 80% hydrogen) and natural gas (such as methane, ethane, propane, or other natural gas). However, it should be appreciated that, in some embodiments, some or all of the fuel nozzles 40, the premix portions 200, and the immersed portions 300 may be fueled by the same fuel supply, such that the same fuel mixture or pure fuel is supplied to some or all of the fuel nozzles 40, the premix portions 200, and the immersed portions 300.

As used herein, the term "premix" may be used to describe a component, passage, or cavity in which fuel and air are mixed together prior to being injected into the combustion chamber 70. In many embodiments, each premix portion 200 may fluidly couple the high pressure plenum 66 to the secondary combustion zone 74. For example, compressed air 15 from the high pressure plenum 66 may enter the premix portion 200 where it is mixed with the second fuel 160 prior to being injected into the secondary combustion zone 74. For example, in exemplary embodiments, each premix portion 200 may extend through the outer sleeve 48, the annulus 47, and the combustion liner 46 and direct a fuel/air mixture into the secondary combustion zone 74. Specifically, the premix portions 200 may each extend radially from the high pressure plenum 66, through the outer sleeve 48, the annulus 47, and the combustion liner 46, such that the premix portion 200 is capable of delivering a second flow of fuel and air to the secondary combustion zone 74. The premix portions 200 may be coupled to the combustion liner 46 and/or the outer sleeve 48, such that each premix portion 200 introduces the second fuel/air mixture as a jet entering a cross-flow of the combustion gases 164 produced in the primary combustion zone 72. The second fuel/air mixture(s) are ignited by the combustion gases 164 from the primary combustion zone 72 and burn in the secondary combustion zone 74.

The premix portion 200 may be coupled to the outer sleeve 48 and may extend through the outer sleeve 48 and the combustion liner 46. In one embodiment, a boss (not shown) supporting the premix portion 200 functions as a fastener for securing the outer sleeve 48 to the combustion liner 46. In other embodiments, the premix portion 200 may be coupled to the outer sleeve 48 in any suitable manner, and the outer sleeve 48 may have any suitable number of components coupled between the flange of the forward casing 50 and the turbine nozzle in any suitable manner that permits the fuel injector 80 to function as described herein.

The immersed portion 300 may extend radially from the premix portion 200 and into the secondary combustion zone 74. For example, the immersed portion 300 may extend radially into the secondary combustion zone 74 of the combustion chamber 70, such that the immersed portion 300 is directly exposed to combustion gases during operation of the combustor 17. The immersed portion 300 may be disposed entirely in the combustion chamber 70.

Figure 3:
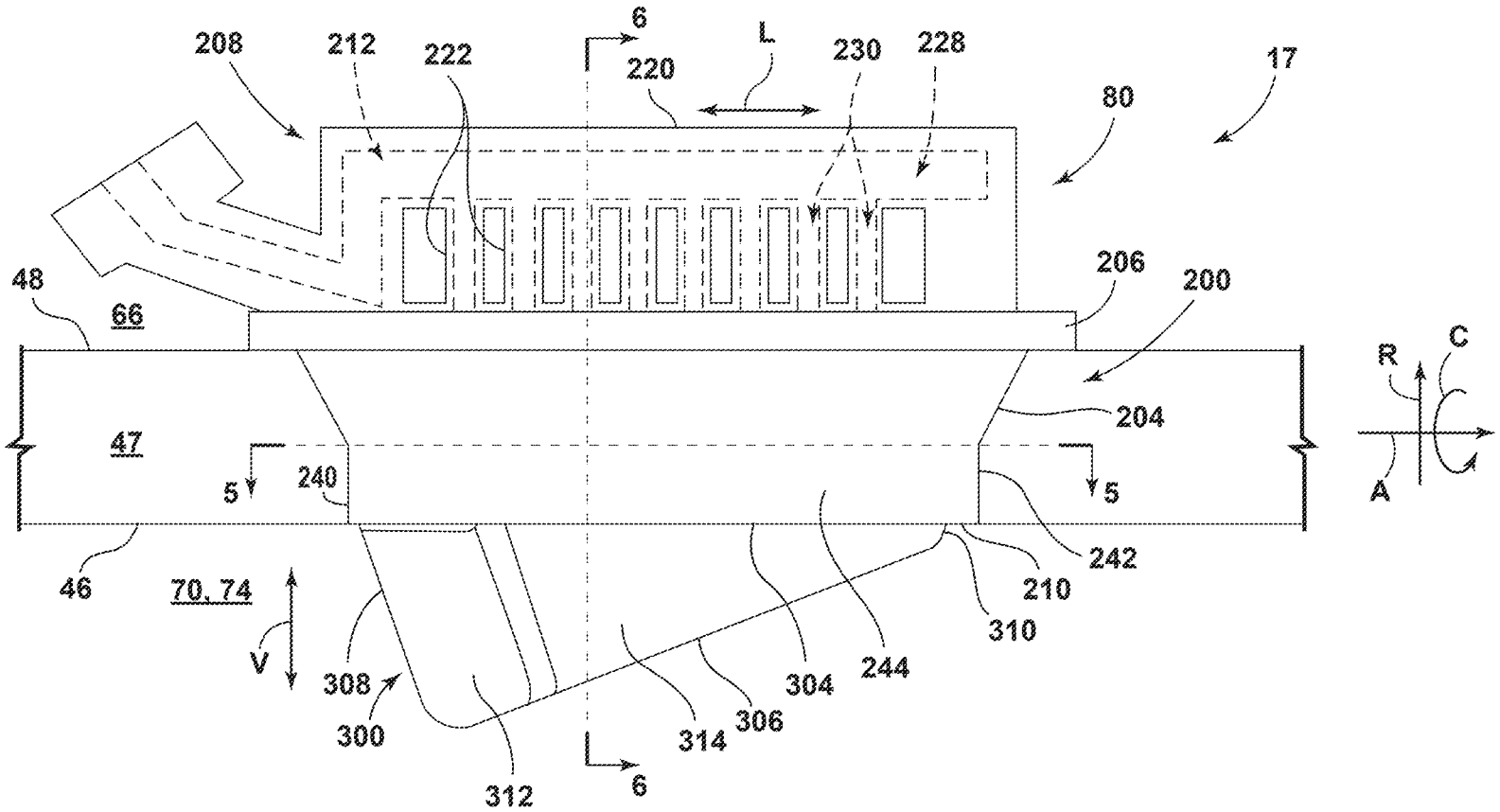
FIG. 3 is an enlarged cross-sectional view of a combustor in accordance with various aspects of the present disclosure.
Figure 4A:
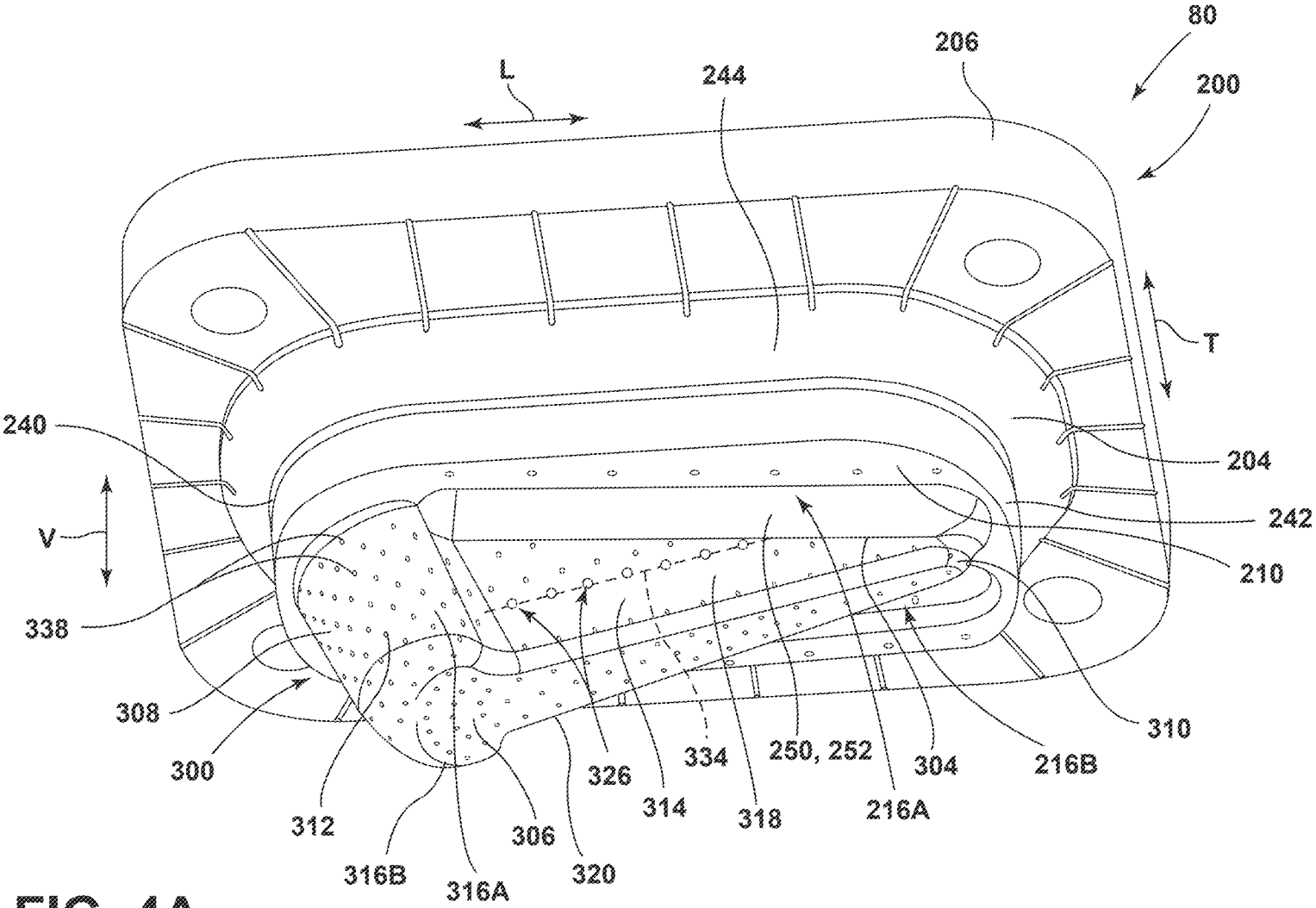
FIG. 4A is a perspective view of a fuel injector in accordance with embodiments of the present disclosure.
Figure 4B:
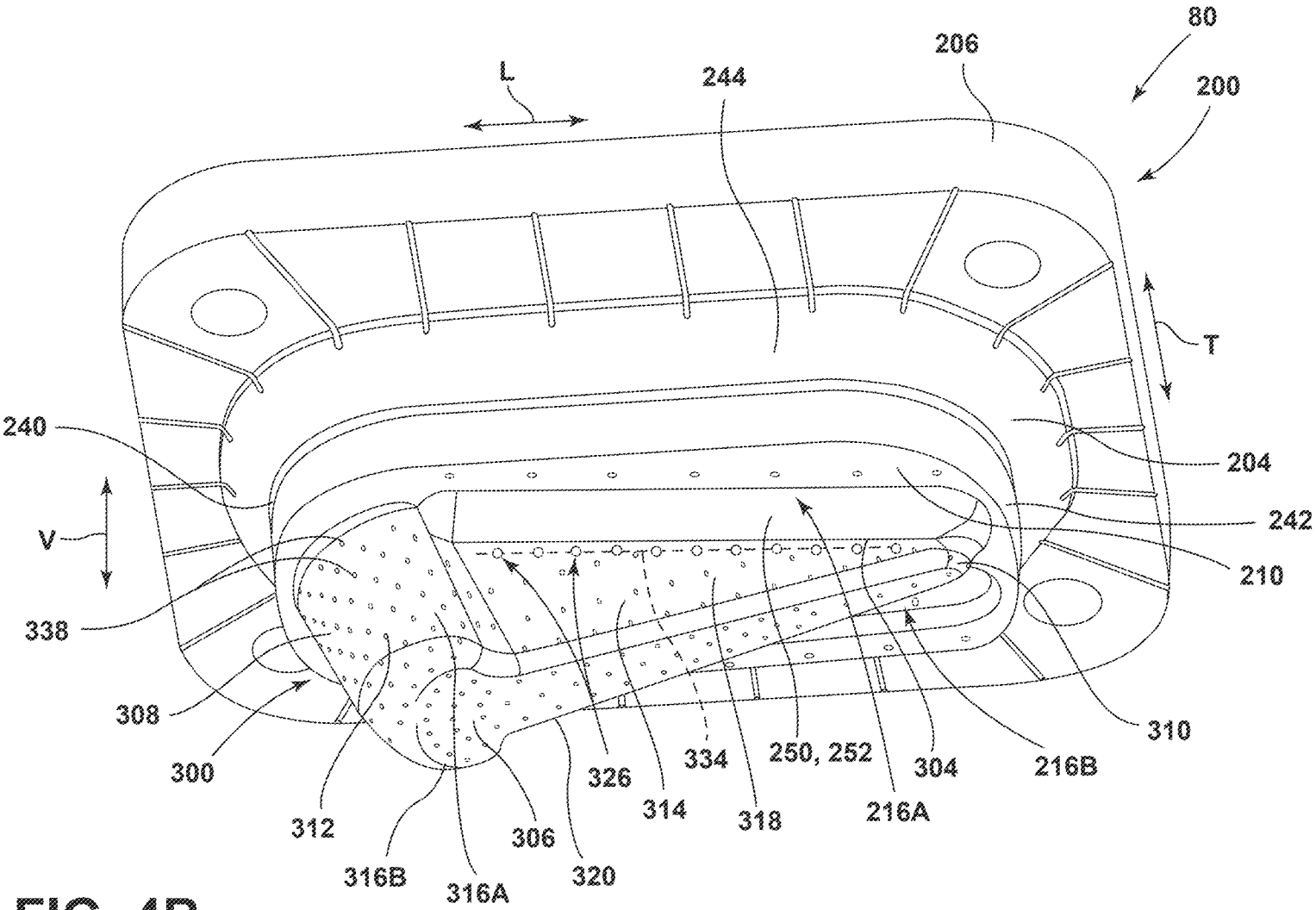
FIG. 4B is a perspective view of a fuel injector in accordance with embodiments of the present disclosure.
Figure 5:
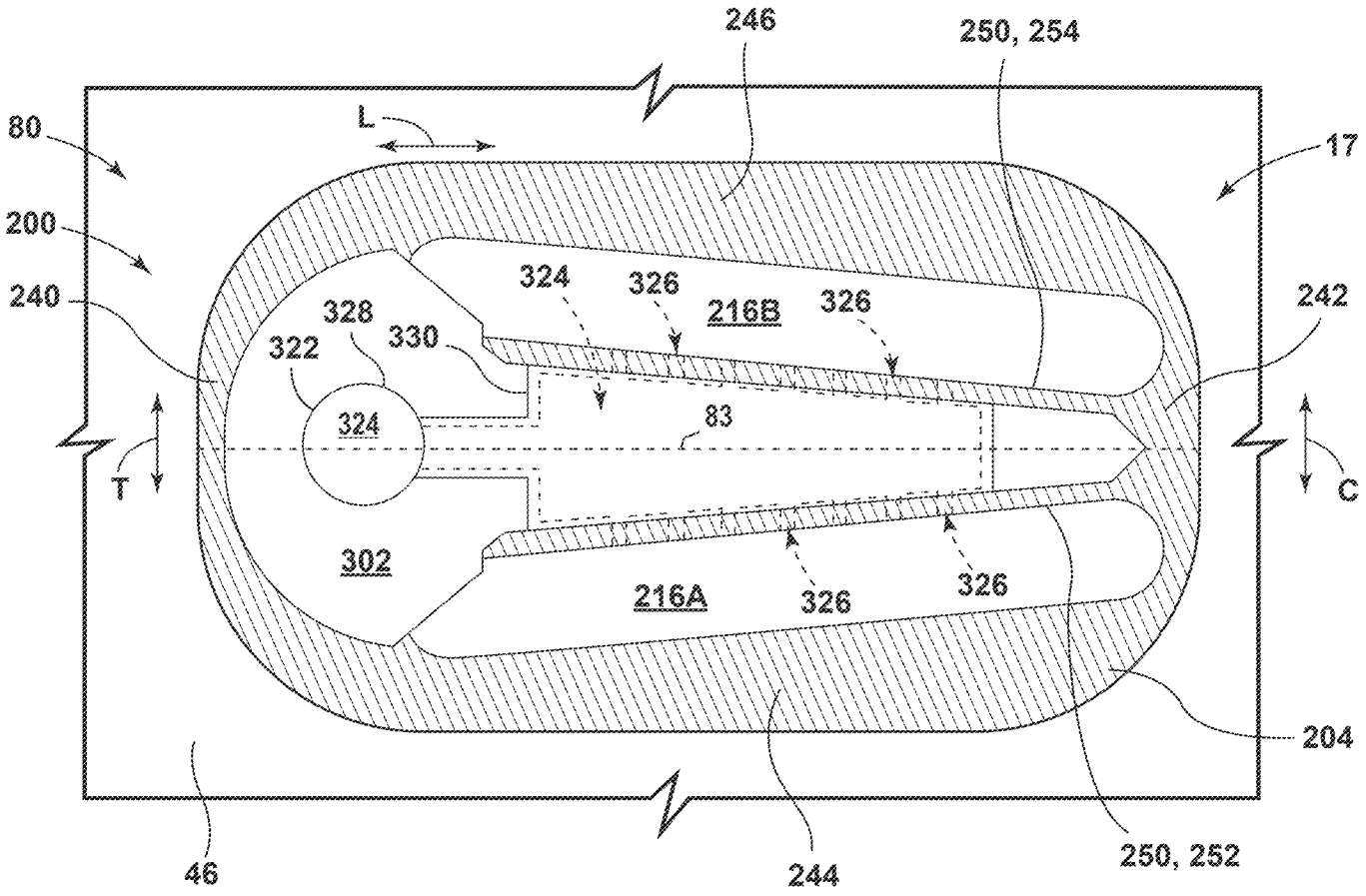
FIG. 5 is a cross-sectional view of the fuel injector shown in FIG. 3 from along the line 5-5 in accordance with embodiments of present disclosure.
Figure 6A:
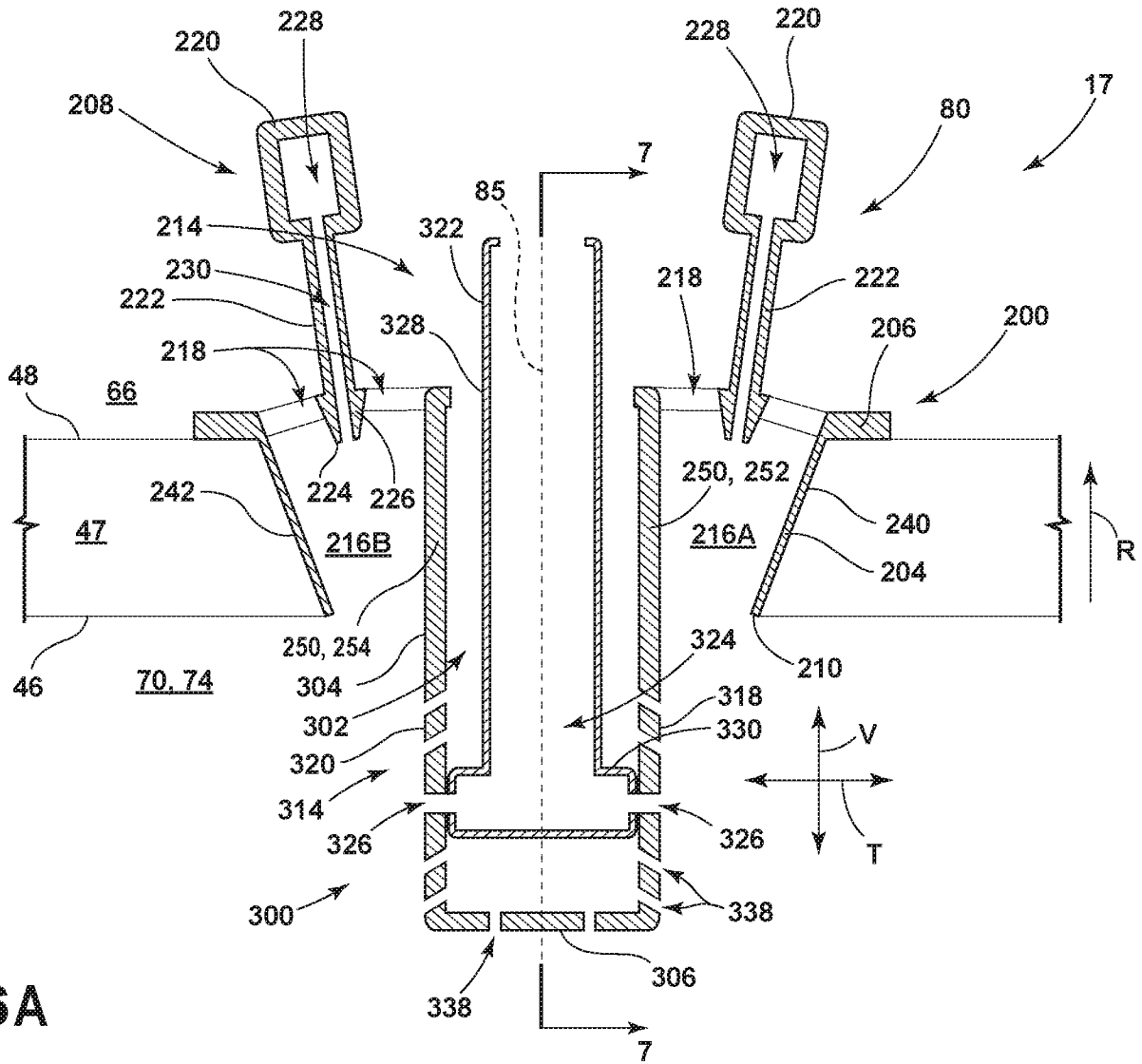
FIGS. 6A and 6B are each a cross-sectional view of the combustor and the fuel injector from along the line 6-6 shown in FIG. 3 in accordance with two different embodiments of the present disclosure.
Figure 6B:
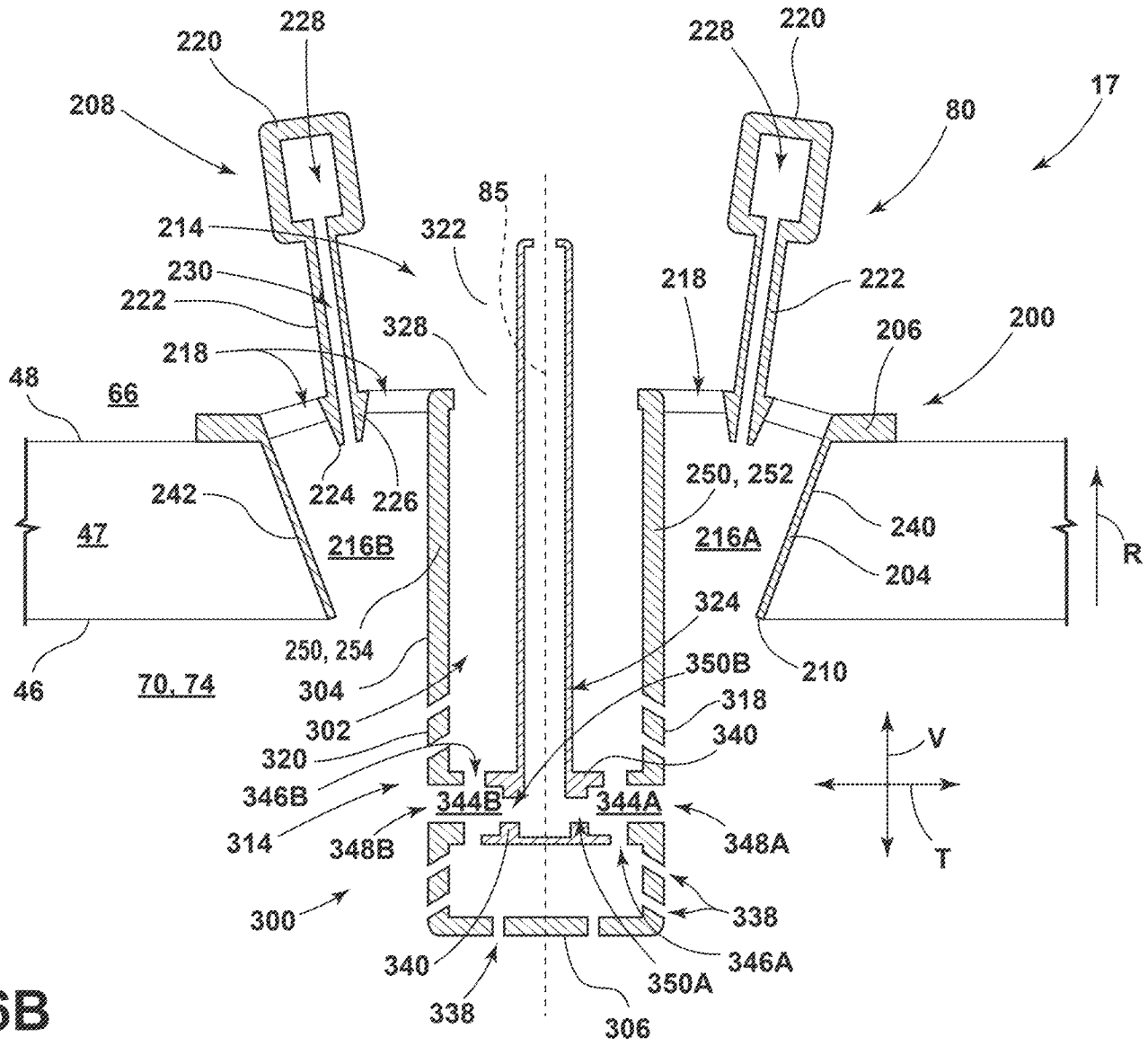
Figure 7:
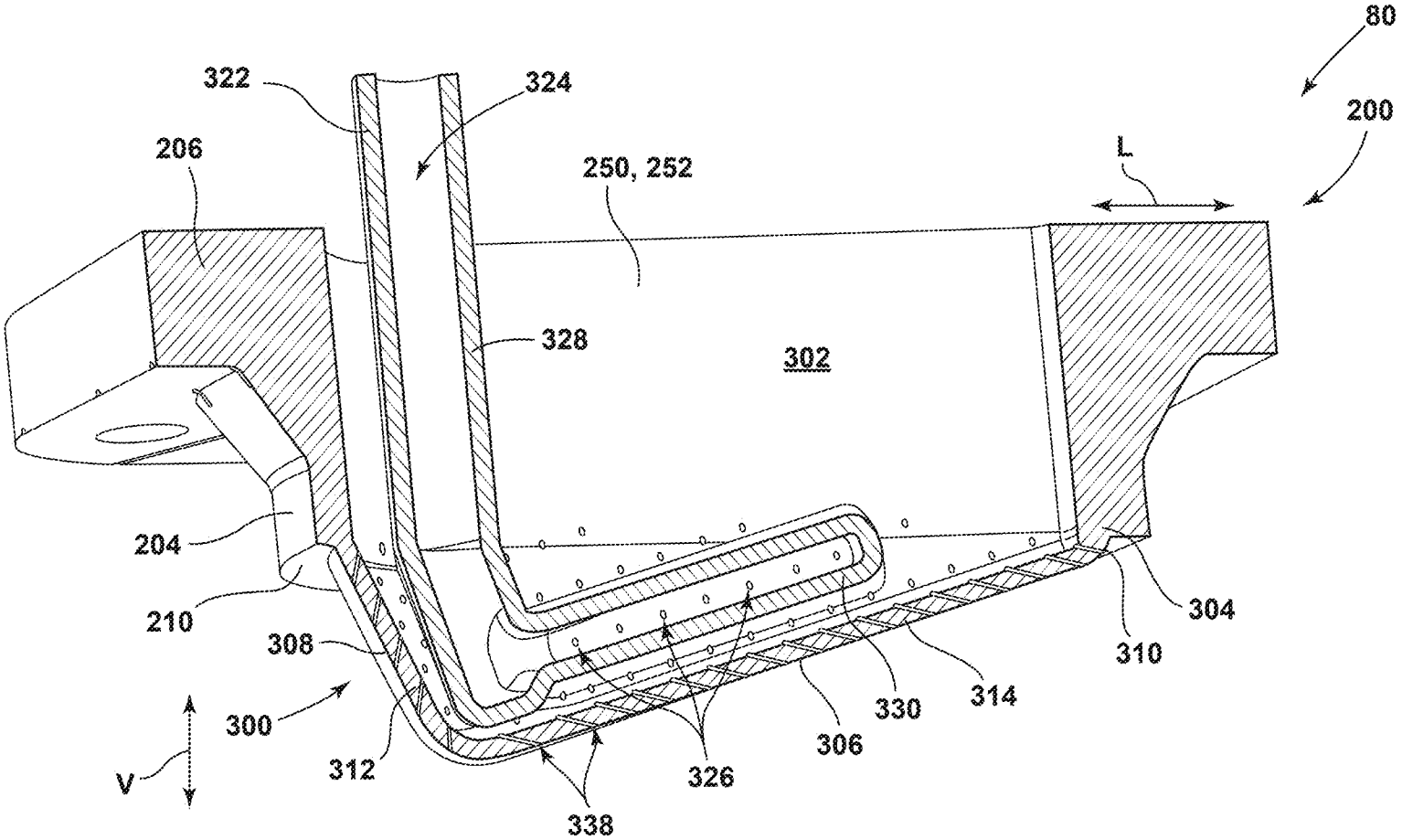
FIG. 7 is a cross-sectional view of the combustor and the fuel injector from along the line 7-7 shown in FIG. 6A in accordance with exemplary aspects of the present disclosure.

Referring now to FIGS. 3 through 6B, various views of the combustor 17 and/or the fuel injector 80 are illustrated in accordance with embodiments of the present disclosure. Specifically, FIG. 3 is an enlarged cross-sectional view of the combustor 17 (but not the fuel injector 80) in accordance with various aspects of the present disclosure. FIGS. 4A and 4B are each a perspective view of a portion of the fuel injector 80 in accordance with various embodiments of the present disclosure. FIG. 5 is a cross-sectional view of the fuel injector 80 from along the line 5-5 shown in FIG. 3 in accordance with embodiments of present disclosure. FIG. 6A is a cross-sectional view of the combustor 17 and the fuel injector 80 from along the line 6-6 shown in FIG. 3 in accordance with a first embodiment of the present disclosure. FIG. 6B is a cross-sectional view of the combustor 17 and the fuel injector 80 from along the line 6-6 shown in FIG. 3 in accordance with a second embodiment of the present disclosure. FIG. 7 is a cross-sectional view of the combustor 17 and the fuel injector 80 from along the line 7-7 shown in FIG. 6A in accordance with exemplary aspects of the present disclosure.

As shown, the fuel injector 80 may define a mutually orthogonal coordinate system having a vertical direction V, a longitudinal direction L, and a transverse direction T. Each of the vertical direction V, the longitudinal direction L, and the transverse direction T may be orthogonal (or perpendicular) to one another. When the fuel injector is installed in a combustor 17, the vertical direction V of the fuel injector 80 may be parallel to the radial direction R of the combustor 17, the longitudinal direction L may be generally parallel to the axial direction A (e.g., within about ±30° of parallel), and the transverse direction T may be tangential to the circumferential direction C. Additionally, as shown in FIG. 5, the fuel injector 80 may extend along a centerline axis 85. The vertical direction V may be parallel to the centerline axis 85, and when the fuel injector 80 is installed in a combustor 17, the centerline axis 85 may be parallel to the radial direction R. Further, as shown in FIG. 5, the fuel injector 80 may extend along a longitudinal center axis 83.

Additionally, as shown, the combustor 17 includes the combustion liner 46 and an outer sleeve 48 radially spaced apart from the combustion liner 46 such that an annulus 47 is defined between the combustion liner 46 and the outer sleeve 48. The high pressure plenum 66 may be defined radially outwardly of the outer sleeve 48, and the combustion chamber 70 may be defined radially inwardly of the combustion liner 46. The injector 80 may extend from the high pressure plenum 66, through the outer sleeve 48, through the annulus 47, through the combustion liner 46, and into the combustion chamber 70.

In exemplary embodiments, the premix portion 200 may include a main body portion 204, a flange portion 206, and a fuel supply portion 208. The flange portion 206 may extend outwardly from the main body 204 (e.g., longitudinally and transversely with respect to the coordinate system of the fuel injector 80 and/or axially and circumferentially with respect to the coordinate system of the combustor 17). The flange portion 206 may be positioned between (e.g., vertically between and/or radially between) the main body portion 204 and the fuel supply portion 208. The main body portion 204 may extend inward (e.g., vertically inward and/or radially inward) from the flange portion 206 to an inner end 210. The premix portion 200 may terminate (vertically and/or radially) at the inner end 210, which may contact an outer surface of the combustion liner 46 (or may be exposed to the combustion gases in some embodiments). In this way, the premix portion 200 may not extend beyond (e.g., radially) the combustion liner 46 and into the combustion chamber 46. By contrast, the immersed portion 300 does extend radially beyond the combustion liner 46 and into the combustion chamber 70.

As shown in FIGS. 3, 6A, and 6B, the fuel supply portion 208 may extend outwardly from the flange portion 206 (e.g., vertically with respect to the coordinate system of the fuel injector 80 and/or radially with respect to the coordinate system of the combustor 17). The flange portion 206 may couple the premix portion 200 to the outer sleeve 48 (e.g., via one or more fasteners). For example, one or more fasteners may extend through the flange portion 206 and the outer sleeve 48 to connect the premix portion 200 to the outer sleeve 48. The fuel supply portion 208 may define a fuel supply circuit 212 (shown in phantom in FIG. 3).

In many embodiments, the main portion 204 of the premix portion 200 may further include a first end wall 240, a second end wall 242, a first side wall 244, and a second side wall 246, which may each extend vertically from the flange 206 to the terminal end 210. The first end wall 240 and the second end wall 242 may be longitudinally spaced apart from one another and may each extend generally transversely between the side walls 244, 246. The first side wall 244 and the second side wall 246 may be transversely spaced apart and may each extend longitudinally between the end walls 240, 242.

The premix portion 200 may define one or more premix passages 216A, 216B. For example, the premix portion 200 may define a first premix passage 216A and a second premix passage 216B. Additionally, the premix portion 200 may further include a partition member 250 that at least partially defines the one or more premix passages 216A, 216B. That is, the partition member 214 may partition the first premix passage 216A and the second premix passage 216B. As shown in FIGS. 4, 6A, 6B, and 7, the immersed portion 300 may extend at least partially from the partition member 250. Additionally, the immersed portion 300 and the partition member 250 may collectively define an air chamber 302. As shown in FIGS. 6A and 6B, the air chamber 302 may receive air from the high pressure plenum 66.

In many embodiments, as shown best in FIG. 5, the partition member 250 may include a first wall 252 and a second wall 254. The first wall 252 may partially define the first premix passage 216A and the air chamber 302. That is, the first wall 252 may partition the first premix passage 216A and the air chamber 302. Similarly, the second wall 254 may partially define the second premix passage 216B and the air chamber 302. That is, the second wall 254 may partition the second premix passage 216B and the air chamber 302. Specifically, as shown in FIG. 5, the first slot 216A may be defined by both the first wall 252 of the partition member 250 and the first side wall 244. Similarly, the second slot 216B may be defined by both the second wall 254 of the partition member 250 and the second side wall 246.

The immersed portion 300 may extend from the partition member 250 into the combustion chamber 70. That is, the immersed portion 300 may extend (e.g., radially) from the partition member 250 into the combustion chamber 70. As shown in FIGS. 6A and 6B, the partition member 250 and the immersed portion 300 may be positioned on, and extend along, the centerline axis 85 of the fuel injector 80. As described above and shown in FIG. 5, the premix portion 200 may define two premixing slots 216A, 216B on either side of the partition member 250. The premixing slots 216A, 216B may be spaced apart from one another (e.g., in the transverse direction T) such that partition member 250 and the immersed portion 300 are disposed between (e.g., transversely between) the premixing slots 216A, 216B.

As shown in FIG. 5, the one or more premixing slots 216A, 216B may be longer in the longitudinal direction L than in the transverse direction T. When the fuel injector 80 is installed in a combustor 17, longitudinal direction L of the fuel injector 80 may be generally parallel to the axial direction A of the combustor 17 (e.g., within about ±30° of parallel). In this way, the fuel injector 80 may advantageously introduce a large amount of fuel and/or air into the secondary combustion zone 74 (e.g., via the immersed portion 300 and the premixing slots 216A, 216B) without having the premix portion 200 impede a large portion of the annulus 47 through which it extends. In other embodiments, the premixing slots 216A, 216B may have a variety of cross-sectional shapes, such as but not limited to a rectangle, oval, stadium shape (e.g., a rectangle having arced or curved ends), or other suitable shapes.

The fuel supply portion 208 (e.g., via the fuel supply circuit 212) may supply fuel to the one or more premixing slots 216A, 216B. Additionally, the premix portion 200 may define one or more air apertures 218 (FIGS. 6A and 6B) for providing air to the one or more premixing slots 216A, 216B. The air apertures 218 may fluidly connect the high pressure plenum 66 and the one or more premixing slots 216A, 216B, such that the one or more premixing slots 216 receives air from the high pressure plenum 66 via the air apertures 218.

As shown in FIGS. 3, 6A, and 6B, the fuel supply portion 208 may include a fuel manifold 220, and a plurality of fuel supply tubes 222 extending from the fuel manifold 220 and into one of the one or more premixing slots 216A, 216B (FIGS. 6A and 6B). The fuel supply tubes 222 may be spaced apart from one another, e.g., longitudinally spaced apart with respect to the coordinate system of the fuel injector 80 and/or axially spaced apart with respect to the coordinate system of the combustor 17 (FIG. 3). Additionally, one or more of the fuel supply tubes 222 may partially define the one or more air apertures 218 (FIGS. 6A and 6B). As shown in FIGS. 6A and 6B, each fuel supply tube 222 of the plurality of fuel supply tubes 222 may extend to a tube end 224. Additionally, each fuel supply tube 222 of the plurality of fuel supply tubes 222 includes a conically shaped portion 226 extending to the tube end 224. The conically shaped portion 226 tapers or converges in diameter as the conically shaped portion 226 extends to the tube end 224. The conically shaped portion 226 at least partially defines the one or more air apertures 218. As shown in FIGS. 3 (in phantom) and 5, the fuel supply circuit 212 may include a common fuel plenum 228 defined in the fuel manifold 220, and each of the fuel supply tubes 222 may define fuel passage 230 that extends from the common fuel plenum 228 to a fuel outlet at the tube end 224.

As shown in FIGS. 6A and 6B, the one or more premix passages 216 may receive air from the high pressure plenum 66 via the air apertures 218 and fuel from the fuel outlet at the tube end 224. The air and the fuel may mix together in the one or more premix passages 216 to generate premixed air/fuel, which may be provided to the combustion chamber 70.

In exemplary embodiments, the immersed portion 300 may extend vertically from a base 304 at the premix portion 200 to a terminal edge 306. Specifically, the base 304 may be defined at the vertical location of the inner end 210 of the premix portion 200. The immersed portion 300 may extend longitudinally between a leading edge 308 and a trailing edge 310. As shown, the immersed portion 300 include a leading portion 312 and a body portion 314. The leading portion 312 may extend (e.g., longitudinally) from the leading edge 308 to the body portion 314. Additionally, the body portion 314 extending from the leading portion 312 to the trailing edge 310. During operation of the combustor 17, the combustion gases may engage the immersed portion 300 at the leading edge 308 and may travel along the immersed portion 300 to the trailing edge 310.

The leading portion 312 may be larger and may protrude transversely from the body portion 314. In many embodiments, the leading portion 312 may overlap in the transverse direction (i.e., transversely overlap) with the premixing slots 216A, 216B, and the leading portion 312 may be longitudinally spaced apart from the premixing slots 216A, 216B. By contrast, the body portion 314 may extend along and partially define the premixing slots 216A, 216B. Additionally, when the fuel injector 80 is positioned in the combustor 17, the slots 216A, 216B may be positioned downstream of the leading portion 312, such that the leading portion may block the oncoming combustion gases from the additional fuel/air being introduced by the slots 216A, 216B. This allows for the fuel/air being introduced by the slots 216A, 216B mix more completely before being exposed to the cross-flow of combustion gases.

In exemplary embodiments, the leading portion 312 may include at least one wing 316A, 316B that protrudes transversely from the body portion 314. Additionally, the body portion 314 may include a first trailing wall 318 and a second trailing wall 320 that each extend from the leading portion 312 to the trailing edge 310. The first trailing wall 318 and the second trailing wall 320 may extend vertically from the partition member 250. The leading portion 312 may extend vertically from the first end wall 240 of the premix portion 200. The first trailing wall 318 and the second trailing wall 320 may each converge towards one another in the transverse direction T as the trailing walls 318, 320 extend in the longitudinal direction L from the leading portion 312 to the trailing edge 310. In exemplary embodiments, as shown in FIGS. 4A and 4B, the at least one wing 316A, 316B includes a first wing 316A that protrudes transversely from the first trailing wall 318 of the body portion 314. Additionally, the at least one wing 316A, 316B includes a second wing 316B that protrudes transversely from the second trailing wall 320 of the body portion 314.

The at least one wing 316A, 316B may be aligned with the slots 216A, 216B. That is, the first wing 314A may transversely overlap with the first slot 216A, and the second wing 314B may transversely overlap with the second slot 216B. in this way, the at least one wing 316A, 316B may block the oncoming combustion gases from the additional fuel/air being introduced by the slots 216A, 216B. This allows for the fuel/air being introduced by the slots 216A, 216B mix more completely before being exposed to the cross-flow of combustion gases. That is, the at least one wing 316A, 316B is configured to shield the premix passages 216A, 216B from the cross-flow of combustion gases In many embodiments, as shown in FIGS. 3, 4, 6A, 6B, and 7, the immersed portion 300 may define a plurality of air apertures 338 that are in fluid communication with the air chamber 302. Particularly, the plurality of air apertures 338 may fluidly connect the air chamber 302 and the combustion chamber 70. As shown in FIGS. 6A and 6B, the plurality of air apertures 338 may be angled (e.g., obliquely angled) relative to the vertical direction, which may advantageously increase the film cooling effectiveness on an exterior surface of the immersed portion 300.

As shown in FIGS. 5, 6A, 6B, and 7, the fuel injector 80 may further include a fuel supply conduit 322 positioned (at least partially) in the air chamber 302. The fuel supply conduit 322 may extend to the immersed portion 300 of the fuel injector 80. That is, the fuel supply conduit 322 may extend to an interior surface of the immersed portion 300. The fuel supply conduit may define a main passage 324, and the body portion 314 of the immersed portion 300 may define a plurality of fuel ports 326 fluidly connected to the main passage 324. In the embodiment shown in FIG. 6A, the fuel injector 80 may supply fuel only via the immersed portion 300. For example, as shown in FIG. 6A, the fuel supply conduit 322 may include a supply portion 328 extending through the partition member 250 and a delivery portion 330. The delivery portion 330 may be positioned in the immersed portion 300 and may extend to (and connect to) the immersed portion 300. The plurality of fuel ports 326 may be defined through the immersed portion 300 and fluidly connected to the delivery portion 330 of the fuel supply conduit 322.

In the embodiment shown in FIG. 6B, the fuel injector 80 may supply both fuel and air (e.g., as a mixture) via the immersed portion 300. For example, as shown in FIG. 6B, the fuel injector 80 may include a compact premixing body 340 positioned in the air chamber 302. The compact premixing body 340 may be fluidly connected to the fuel supply conduit 322 (e.g., to the supply portion 328) and fluidly connected to the air chamber 302, such that the compact premixing body 340 may provide a mixture of fuel and air to the combustion chamber 70.

The compact premixing body 340 may be positioned in the immersed portion 300 and may be connected to (or integral with) the immersed portion 300. The fuel supply conduit 322 may define a fuel supply passage 323, and each of the compact premixing body 340 may define one or more compact premixing chambers 344A, 344B. The compact premixing chambers 344A, 344B may be fluidly connected to each of the air chamber 302, the combustion chamber 70, and the fuel supply passage 323.

That is, the compact premixing chambers 344A, 344B may receive air from the air chamber 302 via a plurality of air apertures 346A, 346B. The compact premixing body 340 defines the plurality of air apertures 346A, 346B that fluidly couple the compact premix chambers 344A, 344B and the air chamber 302. Additionally, the compact premixing chambers 344A, 344B may receive fuel from the fuel passage 323 via fuel channels 350A, 350B. That is, the compact premixing body 340 defines the fuel channels 350A, 350B that each extend from the fuel supply passage 323 to a respective compact premix chamber 344A, 344B. The air and fuel may mix together in the compact premixing chambers 344A, 344B and be provided to the combustion chamber 70 via outlets 348A, 348B.

The compact premixing body 340 may extend between the fuel supply conduit 322 and the immersed portion 300. In many embodiments, the compact premixing body 340 may extend between the fuel supply conduit 322 and at least one of the first trailing wall 318 and the second side wall 320. Specifically, as shown in FIGS. 4, 5, and 7, each of the compact premixing bodies may extend between the first trailing wall 318 and the second trailing wall 320. That is, each compact premixing body 340 may extend from the fuel supply conduit 322 to both of the first trailing wall 318 and the second trailing wall 320.

The compact premix chambers 344A, 344B may each extend to a respective outlet on one of the first trailing wall 318 or the second trailing wall 320. Specifically, each compact premixing body 340 may define a first compact premix chamber 344A extending to a first outlet 348A at the first trailing wall 318 and a second compact premix chamber 344B extending to a second outlet 348B at the second trailing wall 320. The compact premixing body 340 may be generally cylindrically shaped and may define a centerline axis that is generally parallel to the transverse direction T.

In many embodiments, the compact premixing body 340 defines a plurality of first air apertures 346A and a plurality of second air apertures 346B. The plurality of first air apertures 346A may fluidly connect the air chamber 302 and the first compact premix chamber 344A, and the plurality of second air apertures 346B that may fluidly connect the air chamber 302 and the second premix chamber 344B.

In many embodiments, the first trailing wall 318 may define a first plurality of fuel ports 326, and the second trailing wall 320 may define a second plurality of fuel ports 326. In exemplary embodiments, as shown in FIGS. 4A and 4B, the plurality of fuel ports 326 may be positioned on a row axis 334. In some embodiments, as shown in FIG. 4A, the row axis 334 may be angled (e.g., obliquely angled) relative to the vertical direction V and the longitudinal direction L. In such embodiments, as shown in FIG. 4A, the row axis 334 may be generally parallel to the terminal edge 306. In other embodiments, as shown in FIG. 4B, the row axis 334 may be generally parallel to the longitudinal direction L. In further embodiments, the row axis 334 may have any orientation, such as vertical (or mostly vertical), or any other orientation.

Additionally, as shown in FIG. 4A, the row axis 334 may be angled such that each fuel port 326 is vertically spaced apart from a neighboring fuel port 326, with fuel ports 326 closer to the leading portion being spaced further from the base 304 than fuel ports 326 closer to the trailing edge 310. By contrast, as shown in FIG. 4B, the row axis 334 may be generally parallel to the longitudinal direction L such that each fuel port 326 is vertically aligned with a neighboring fuel port 326 (i.e., not vertically spaced). Further, as shown in FIG. 4B, the fuel ports 326 may be proximate to the base 304 of the immersed portion 300 and disposed on the body portion 314. That is, as shown in FIG. 4B, each of the fuel ports 326 may be equally vertically spaced from the base 304 and closer to the base 304 than the terminal edge 306.

Further, with reference to FIGS. 4A and 4B, the apertures defined in the immersed portion 300 that are positioned along the row axis 334 are the plurality of fuel ports 326, and all other apertures are the air apertures 338. In this way, as shown in FIGS. 4A and 4B, the air apertures 338 may generally surround the plurality of fuel ports 326. In some embodiments, as shown, the air apertures 338 may define a diameter that is smaller than a diameter of the fuel ports 326. In other embodiments (not shown), the air apertures 338 may define a diameter that is larger than a diameter of the fuel ports 326. While the fuel ports 326 and the air apertures 338 are shown as having a circular shape, other shapes may be possible (such as a non-uniform shape, oval shape, rectangular shape, triangular shape, polygonal shape, round shape, or other shape), and the present disclosure should not be limited to any particular shape for these features unless specifically recited in the claims.

Figure 9:
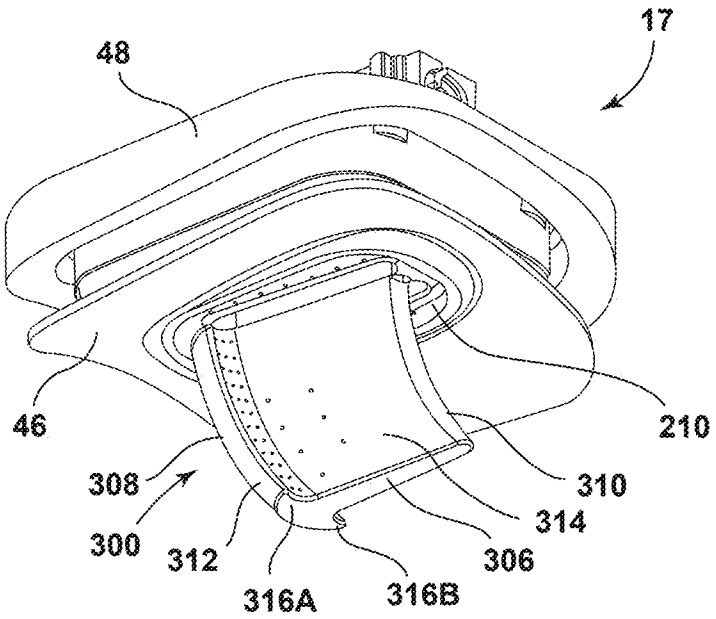
FIG. 9 is the fuel injector shown in FIG. 8 installed in a combustor in accordance with embodiments of the present disclosure.
Figure 8:
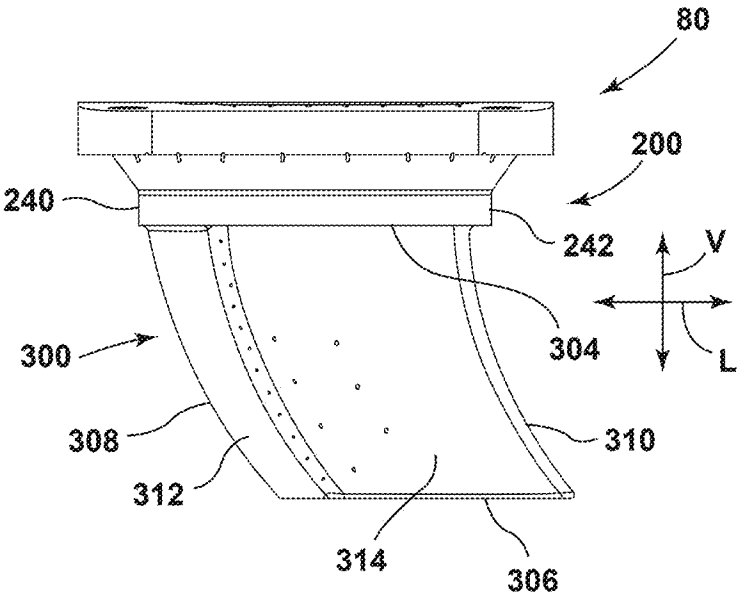
FIG. 8 is a side view of a fuel injector in accordance with embodiments of the present disclosure.
Figure 11:
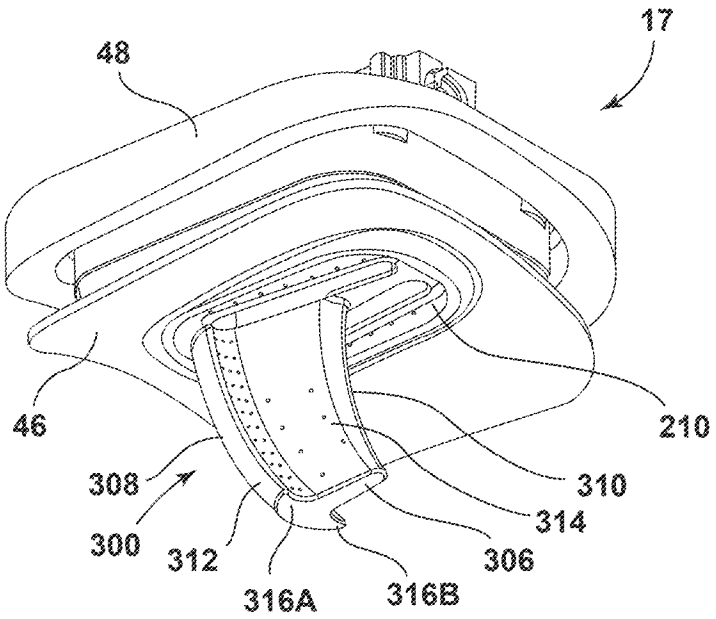
FIG. 11 is the fuel injector shown in FIG. 10 installed in a combustor in accordance with embodiments of the present disclosure.
Figure 10:
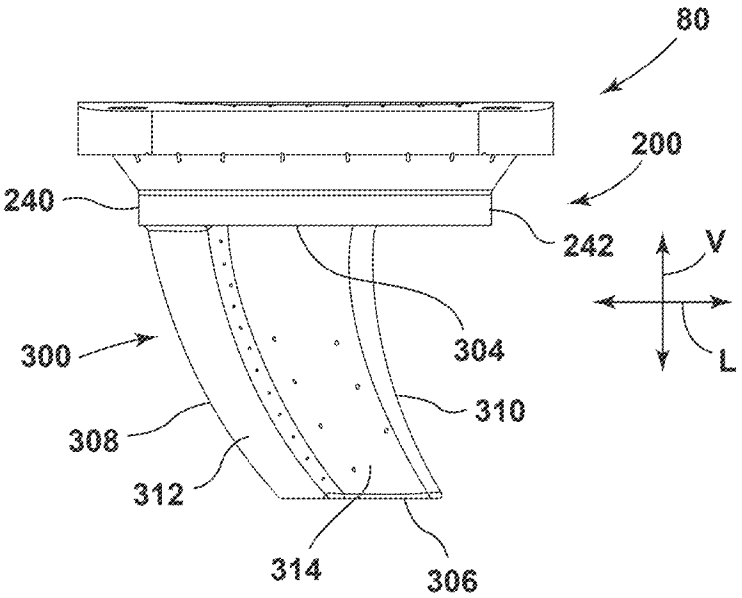
FIG. 10 is a side view of a fuel injector in accordance with embodiments of the present disclosure.
Figure 12:
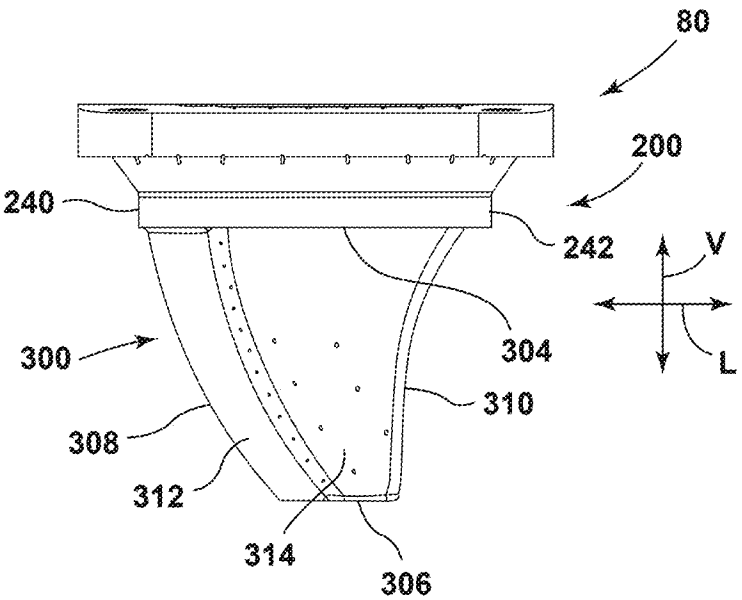
FIG. 12 is a side view of a fuel injector in accordance with embodiments of the present disclosure.
Figure 13:
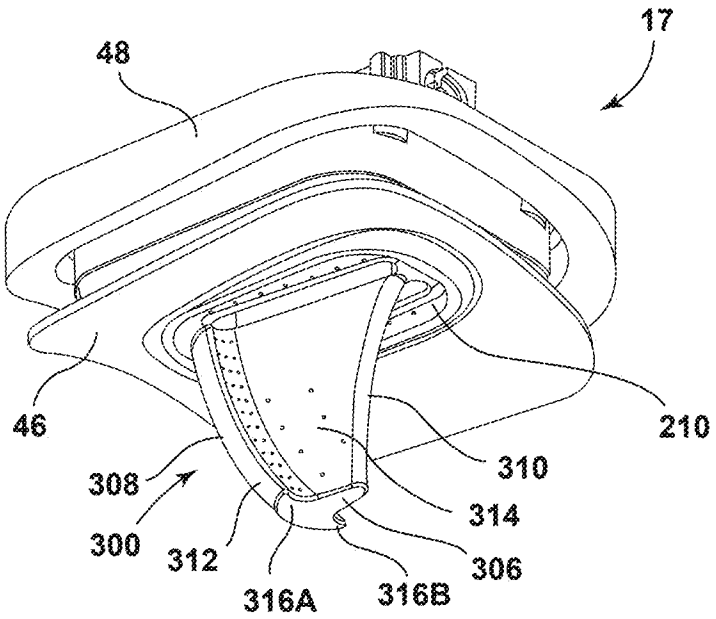
FIG. 13 is the fuel injector shown in FIG. 12 installed in a combustor in accordance with embodiments of the present disclosure.

Referring now to FIGS. 8-13, various embodiments of a fuel injector 80 are illustrated in accordance with the present disclosure. Particularly, FIG. 8 is a side view of a fuel injector 80 in accordance with embodiments of the present disclosure, and FIG. 9 is the fuel injector 80 shown in FIG. 8 installed in a combustor 17. Similarly, FIG. 10 is a side view of a fuel injector 80 in accordance with embodiments of the present disclosure, and FIG. 11 is the fuel injector 80 shown in FIG. 10 installed in a combustor 17. Likewise, FIG. 12 is a side view of a fuel injector 80 in accordance with embodiments of the present disclosure, and FIG. 13 is the fuel injector 80 shown in FIG. 12 installed in a combustor 17.

As shown in FIGS. 9, 11, and 13, the combustor 17 includes the combustion liner 46 and an outer sleeve 48 radially spaced apart from the combustion liner 46 such that an annulus is defined between the combustion liner 46 and the outer sleeve 48. The injector 80 may extend through the outer sleeve 48, the combustion liner 46, and into the combustion chamber 70.

As described above and shown in FIGS. 8, 10, and 12, the fuel injector 80 includes a premix portion 200 and an immersed portion 300 extending from the premix portion 200. The immersed portion 300 extends vertically from the base 304 and the terminal edge 306. The immersed portion 300 may extend longitudinally between a leading edge 308 and a trailing edge 310. As shown, the immersed portion 300 include a leading portion 312 and a body portion 314.

Referring back to FIGS. 3 and 7 briefly, in some embodiments, the terminal edge 306 may be a planar surface that is angled relative to the longitudinal direction L in a vertical-longitudinal plane (e.g., the plane of FIG. 3) such that the terminal edge 306 extends towards the premix portion 200 as the immersed portion extends longitudinally from the leading edge 308 to the trailing edge 310. In other embodiments, as shown in FIGS. 8, 10, and 12, the terminal edge 306 may be a planar surface that is parallel to the longitudinal direction L in a vertical-longitudinal plane (e.g., the plane of FIGS. 8, 10, and 12). In some embodiments, as shown in FIGS. 3, 8, and 12, the trailing edge 310 may extend vertically from the second end wall 242. In other embodiments, as shown in FIG. 10, the trailing edge 310 may be longitudinally spaced apart from the second end wall 242.

In some embodiments, as shown in FIGS. 8 and 10, the leading edge 308 and the trailing edge 310 may generally have the same curvature, such that a longitudinal distance between the leading edge 308 and the trailing edge 310 may be generally constant (e.g., within ±10% of constant) as the immersed portion 300 extends vertically from the base 304 to the terminal edge 306. Alternatively, in other embodiments as shown in FIG. 12, the leading edge 308 and the trailing edge 310 may converge towards one another as the leading edge 308 and the trailing edge 310 extend vertically from the base 304 to the terminal edge 306. In such an embodiment, the longitudinal distance between the leading edge 308 and the trailing edge 310 may decrease as the immersed portion 300 extends vertically from the base 304 to the terminal edge 306. In some embodiments, as shown in FIGS. 8 and 9, the leading edge 308 and the trailing edge 310 may include a curvature, such that the terminal edge 306 may be longitudinally offset from the base 304 of the immersed injector 300.

As shown in FIGS. 10 and 11, the leading edge 308 may extend from the first end wall 240. That is, the leading edge 308 may be longitudinally aligned with the first end wall 240 at the base of the immersed portion 300. By contrast, the trailing edge 310 of the immersed portion 300 may be spaced apart from the second end wall 242. For example, the trailing edge 310 of the immersed portion 300 may be longitudinally spaced apart from the second end wall 242.

In some embodiments, a method of operating the injector may be provided. The method may include providing premixed air and fuel through the premixing passages and into the combustion chamber. The injector includes a leading portion that overlaps or blocks a forward portion of the premixing passages, which allows the premix air and fuel to continue mixing after an exit plane of the premix passage but before the premix air and fuel interacts with a cross-flow of combustion gases flowing through the combustion chamber. That is, the leading portion provides a blockage from the crossflow for the premix passages, and the blockage generates turbulence in the crossflow that enhances mixing of the premix fuel and air injected by the premix passages and by fuel ports defined in the immersed injector. This method may enable operation on alternative fuels, such as hydrogen, without causing flame holding or flashback issues that may otherwise occur.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A fuel injector defining a mutually orthogonal coordinate system that includes a longitudinal direction, a transverse direction, and a vertical direction, the fuel injector comprising: a premix portion defining a premix passage; an immersed portion extending vertically from a base at the premix portion to a terminal edge, the immersed portion extending longitudinally between a leading edge and a trailing edge, the immersed portion including a leading portion and a body portion, the leading portion extending from the leading edge to the body portion, the body portion extending from the leading portion to the trailing edge, wherein the leading portion includes at least one wing that protrudes transversely from the body portion, wherein the at least one wing is aligned with the premix passage.

The fuel injector as in any preceding clause, wherein the body portion includes a first trailing wall and a second trailing wall that each extend from the leading portion to the trailing edge, and wherein the at least one wing includes a first wing that protrudes transversely from the first trailing wall of the body portion and a second wing that protrudes transversely from the second trailing wall of the transverse portion.

The fuel injector as in any preceding clause, wherein the premix portion further includes a partition member that partially defines the premix passage, wherein the immersed portion extends at least partially from the partition member, and wherein the partition member and the immersed portion collectively define an air chamber.

The fuel injector as in any preceding clause, wherein the premix passage is a first premix passage, and wherein the premix portion defines a second premix passage at least partially via the partition member.

The fuel injector as in any preceding clause, wherein the partition member includes a first wall that partially defines the first premix passage and the air chamber, and wherein the partition member includes a second wall that partially defines the second premix passage and the air chamber.

The fuel injector as in any preceding clause, wherein the immersed portion defines a plurality of air apertures fluidly connected to the air chamber.

The fuel injector as in any preceding clause, further comprising a fuel supply conduit extending to the immersed portion, the fuel supply conduit defining a main fuel passage, and wherein the body portion of the immersed portion defines a plurality of fuel ports fluidly connected to the main fuel passage.

The fuel injector as any preceding clause 7, wherein the plurality of fuel ports are each positioned on a row axis.

The fuel injector as in any preceding clause, wherein the row axis is angled relative to the vertical direction and the longitudinal direction.

The fuel injector as in any preceding clause, wherein the terminal edge is a surface that is angled relative to the longitudinal direction in a vertical-longitudinal plane such that the terminal edge extends towards the premix portion as the immersed portion extends longitudinally from the leading edge to the trailing edge.

The fuel injector as in any preceding clause, wherein the terminal edge is a surface that is parallel to longitudinal direction in a vertical-longitudinal plane.

The fuel injector as in any preceding clause, wherein the leading edge and the trailing edge converge towards one another as the leading edge and the trailing edge extend vertically from the base to the terminal edge.

A combustor comprising: a combustion liner defining a combustion chamber; a fuel injector extending at least partially through the combustion liner, the fuel injector defining a mutually orthogonal coordinate system that includes a longitudinal direction, a transverse direction, and a vertical direction, the fuel injector comprising: a premix portion defining a premix passage; an immersed portion positioned in the combustion chamber, the immersed portion extending vertically from a base at the premix portion to a terminal edge, the immersed portion extending longitudinally between a leading edge and a trailing edge, the immersed portion including a leading portion and a body portion, the leading portion extending from the leading edge to the body portion, the body portion extending from the leading portion to the trailing edge, wherein the leading portion includes at least one wing that protrudes transversely from the body portion, wherein the at least one wing is aligned with the premix passage.

The combustor as in any preceding clause, wherein the body portion includes a first trailing wall and a second trailing wall that each extend from the leading portion to the trailing edge, and wherein the at least one wing includes a first wing that protrudes transversely from the first trailing wall of the body portion and a second wing that protrudes transversely from the second trailing wall of the transverse portion.

The combustor as in any preceding clause, wherein the premix portion further includes a partition member that partially defines the premix passage, wherein the immersed portion extends at least partially from the partition member, and wherein the partition member and the immersed portion collectively define an air chamber.

The combustor as in any preceding clause, wherein the premix passage is a first premix passage, and wherein the premix portion defines a second premix passage at least partially via the partition member.

The combustor as in any preceding clause, wherein the partition member includes a first wall that partially defines the first premix passage and the air chamber, and wherein the partition member includes a second wall that partially defines the second premix passage and the air chamber.

The combustor as in any preceding clause, wherein the immersed portion defines a plurality of air apertures fluidly connected to the air chamber.

The combustor as in any preceding clause, further comprising a fuel supply conduit positioned in the air chamber and extending to the immersed portion, the fuel supply conduit defining a main fuel passage, and wherein the body portion of the immersed portion defines a plurality of fuel ports fluidly connected to the main fuel passage.

The combustor as in any preceding clause, wherein the plurality of fuel ports are each positioned on a row axis

What is claimed is:

1. A fuel injector defining a mutually orthogonal coordinate system that includes a longitudinal direction, a transverse direction, and a vertical direction, the fuel injector comprising:

a premix portion defining a premix passage, the premix portion extending longitudinally between a first end wall and a second end wall;

an immersed portion extending vertically from a base at the premix portion to a terminal edge, the immersed portion extending longitudinally between a leading edge and a trailing edge, the immersed portion including a leading portion and a body portion, the leading portion extending from the leading edge to the body portion, the body portion extending from the leading portion to the trailing edge, wherein the leading portion protrudes transversely from the body portion and is aligned with the premix passage, and wherein the leading portion extends vertically from the first end wall.

2. The fuel injector as in claim 1, wherein the body portion includes a first trailing wall and a second trailing wall that each extend from the leading portion to the trailing edge, and wherein the leading portion includes a first wing that protrudes transversely from the first trailing wall of the body portion and a second wing that protrudes transversely from the second trailing wall of the body portion.

3. The fuel injector as in claim 1, wherein the premix portion further includes a partition member that partially defines the premix passage, wherein at least part of the immersed portion extends from the partition member, and wherein the partition member and the immersed portion collectively define an air chamber.

4. The fuel injector as in claim 3, wherein the premix passage is a first premix passage, and wherein the premix portion defines a second premix passage at least partially via the partition member.

5. The fuel injector as in claim 4, wherein the partition member includes a first wall that partially defines the first premix passage and the air chamber, and wherein the partition member includes a second wall that partially defines the second premix passage and the air chamber.

6. The fuel injector as in claim 3, wherein the immersed portion defines a plurality of air apertures fluidly connected to the air chamber.

7. The fuel injector as in claim 3, further comprising a fuel supply conduit extending to the immersed portion, the fuel supply conduit defining a main fuel passage, and wherein the body portion of the immersed portion defines a plurality of fuel ports fluidly connected to the main fuel passage.

8. The fuel injector as in claim 7, wherein the plurality of fuel ports are each positioned on a row axis.

9. The fuel injector as in claim 8, wherein the row axis is angled relative to the vertical direction and the longitudinal direction.

10. The fuel injector as in claim 1, wherein the terminal edge is a surface that is angled relative to the longitudinal direction in a vertical-longitudinal plane such that the terminal edge extends towards the premix portion as the immersed portion extends longitudinally from the leading edge to the trailing edge.

11. The fuel injector as in claim 1, wherein the terminal edge is a surface that is parallel to longitudinal direction in a vertical-longitudinal plane.

12. The fuel injector as in claim 1, wherein the leading edge and the trailing edge converge towards one another as the leading edge and the trailing edge extend vertically from the base to the terminal edge.

13. A combustor comprising:

a combustion liner defining a combustion chamber;

a fuel injector extending at least partially through the combustion liner, the fuel injector defining a mutually orthogonal coordinate system that includes a longitudinal direction, a transverse direction, and a vertical direction, the fuel injector comprising:

a premix portion defining a premix passage, the premix portion extending longitudinally between a first end wall and a second end wall;

an immersed portion positioned in the combustion chamber, the immersed portion extending vertically from a base at the premix portion to a terminal edge, the immersed portion extending longitudinally between a leading edge and a trailing edge, the immersed portion including a leading portion and a body portion, the leading portion extending from the leading edge to the body portion, the body portion extending from the leading portion to the trailing edge, wherein the leading portion protrudes transversely from the body portion and is aligned with the premix passage, and wherein the leading portion extends vertically from the first end wall.

14. The combustor as in claim 13, wherein the body portion includes a first trailing wall and a second trailing wall that each extend from the leading portion to the trailing edge, and wherein the leading portion includes a first wing that protrudes transversely from the first trailing wall of the body portion and a second wing that protrudes transversely from the second trailing wall of the body portion.

15. The combustor as in claim 13, wherein the premix portion further includes a partition member that partially defines the premix passage, wherein the immersed portion extends at least partially from the partition member, and wherein the partition member and the immersed portion collectively define an air chamber.

16. The combustor as in claim 15, wherein the immersed portion defines a plurality of air apertures fluidly connected to the air chamber.

17. The combustor as in claim 15, wherein the premix passage is a first premix passage, and wherein the premix portion defines a second premix passage at least partially via the partition member.

18. The combustor as in claim 17, wherein the partition member includes a first wall that partially defines the first premix passage and the air chamber, and wherein the partition member includes a second wall that partially defines the second premix passage and the air chamber.

19. The combustor as in claim 17, further comprising a fuel supply conduit positioned in the air chamber and extending to the immersed portion, the fuel supply conduit defining a main fuel passage, and wherein the body portion of the immersed portion defines a plurality of fuel ports fluidly connected to the main fuel passage.

20. A fuel injector defining a mutually orthogonal coordinate system that includes a longitudinal direction, a transverse direction, and a vertical direction, the fuel injector comprising:

a premix portion defining a premix passage, wherein the premix portion further includes a partition member that partially defines the premix passage;

an immersed portion extending vertically from a base at the premix portion to a terminal edge, the immersed portion extending longitudinally between a leading edge and a trailing edge, the immersed portion including a leading portion and a body portion, the leading portion extending from the leading edge to the body portion, the body portion extending from the leading portion to the trailing edge, wherein the leading portion protrudes transversely from the body portion and is aligned with the premix passage, wherein at least part of the immersed portion extends from the partition member, wherein the partition member and the immersed portion collectively define an air chamber, and wherein the immersed portion defines a plurality of air apertures fluidly connected to the air chamber.

* * * * *